US008202370B2

(12) United States Patent
Sakurai et al.

(10) Patent No.: US 8,202,370 B2
(45) Date of Patent: Jun. 19, 2012

(54) METHOD FOR REMOVING ACIDIC DEPOSIT

(75) Inventors: Shigeru Sakurai, Chiyoda-ku (JP); Masaharu Emoto, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 448 days.

(21) Appl. No.: 11/924,052

(22) Filed: Oct. 25, 2007

(65) Prior Publication Data

US 2008/0053483 A1 Mar. 6, 2008

Related U.S. Application Data

(63) Continuation of application No. PCT/JP2006/315024, filed on Jul. 28, 2006.

(30) Foreign Application Priority Data

Aug. 9, 2005 (JP) ..... 2005-230827

(51) Int. Cl.
*B08B 9/027* (2006.01)
*B08B 3/04* (2006.01)

(52) U.S. Cl. ..... 134/22.11; 134/2; 134/36

(58) Field of Classification Search ..... 134/2, 22.1, 134/22.11, 22.12, 26, 29, 34, 36, 42
See application file for complete search history.

(56) References Cited

U.S. PATENT DOCUMENTS

| | | | | |
|---|---|---|---|---|
| 5,641,895 | A * | 6/1997 | Grant | 73/64.56 |
| 6,524,397 | B2 * | 2/2003 | Sakurai et al. | 134/29 |
| 6,943,878 | B2 * | 9/2005 | Fisher et al. | 356/300 |
| 2001/0039958 | A1 * | 11/2001 | Sakurai et al. | 134/29 |
| 2006/0107970 | A1 * | 5/2006 | Verhaverbeke et al. | 134/2 |

FOREIGN PATENT DOCUMENTS

| | | | |
|---|---|---|---|
| EP | 1143037 | | 10/2001 |
| JP | 54-109502 | A * | 8/1979 |

(Continued)

OTHER PUBLICATIONS

Translation of JP 61-27402.*

(Continued)

*Primary Examiner* — Michael Kornakov
*Assistant Examiner* — Nicole Blan
(74) *Attorney, Agent, or Firm* — Oblon, Spivak, McClelland, Maier & Neustadt, L.l.P.

(57) ABSTRACT

To provide a method for removing an acidic deposit containing a sulfur compound, whereby the terminal point of the cleaning state can be ascertained simply and efficiently without necessity to visually directly observe the cleaning state or to observe the behavior of the pH value of the cleaning fluid. A method for removing an acidic deposit containing a sulfur compound, which comprises contacting the acidic deposit with a prescribed amount of an aqueous cleaning fluid, characterized in that the concentration of sulfate ion ($SO_4^{2-}$) in the aqueous cleaning fluid is measured, and the contact with the aqueous cleaning fluid is terminated after the increase per hour of the measured value becomes 15 not more than 10%.

16 Claims, 1 Drawing Sheet

FOREIGN PATENT DOCUMENTS

| | | | | |
|---|---|---|---|---|
| JP | 61-27402 | A | * | 2/1986 |
| JP | 61-39240 | | | 3/1986 |
| JP | 10-263525 | A | | 10/1998 |
| JP | 2001-262190 | A | | 9/2001 |
| JP | 2001-348689 | A | | 12/2001 |
| JP | 2003-213470 | A | | 7/2003 |
| JP | 2005-197665 | A | | 7/2005 |
| JP | 2005197665 | A | * | 7/2005 |
| WO | WO 01/32804 | A1 | | 5/2001 |

OTHER PUBLICATIONS

Translation of JP 2005197665 A.*
Translation of JP 54-109502.*
Symeopoulos et al., Spontaneous Precipitation of Barium Sulfate in Aqueous Solution, 1992, J. Chem. Soc., pp. 3063-3066.*
Patterson et al., Kubelka-Munk optical properties of a barium sulfate white reflectance standard, 1977, Applied Optics pp. 729-732.*

* cited by examiner

METHOD FOR REMOVING ACIDIC DEPOSIT

TECHNICAL FIELD

The present invention relates to a method for removing an acidic deposit deposited on a combustion apparatus such as a boiler.

BACKGROUND ART

When a fuel such as heavy oil, residual oil or coal is burned, sulfur contained in the fuel will be burned to form sulfur dioxide ($SO_2$). Further, this sulfur dioxide will be partially oxidized to form sulfur trioxide ($SO_3$), which will be reacted with moisture in the flue gas to form sulfuric acid ($H_2SO_4$). Accordingly, on an apparatus or piping disposed between a combustion furnace of a boiler and a chimney, a mixture containing unburned ash and an acidic component derived from the fuel, such as sulfuric acid, is likely to be deposited. Especially when the temperature of the flue gas is lowered to a level of not higher than the dew point of the sulfuric acid, such deposition tends to be remarkable, and cleaning of the apparatus or piping is essential to maintain the stable operation.

Heretofore, it has been common to employ a cleaning method to wash off the acidic deposit on equipments by using industrial water. As a method for effectively removing the acidic deposit without exposing the instruments to a corrosive environment, a method has been practically employed which utilizes a neutralization reaction by means of sodium hydrogencarbonate as shown in Patent Document 1.

In the cleaning, it becomes important to ascertain the finish state. As in the cleaning of the interior of an apparatus or the interior of slender piping, it is not necessarily possible to carry out the cleaning while the cleaning state of the portion to be cleaned, is observed. Therefore, in the case of washing off the acidic deposit with water or in the case of washing by means of sodium hydrogencarbonate, it has been common to ascertain the cleaning state by observing the change in the value of the hydrogen ion concentration (pH) of the cleaning fluid. For example, in a case where cleaning is carried out by circulating an aqueous solution having an excess amount of sodium hydrogencarbonate dissolved in water, neutralization of the acidic deposit will advance as the cleaning progresses, and the pH value of the cleaning fluid will increase gradually, and it has been considered possible to judge that the cleaning has been done when the cleaning fluid has become to show the pH value of the aqueous sodium hydrogencarbonate solution itself.

Patent Document 1: JP-A-2001-348689

DISCLOSURE OF THE INVENTION

Problems to be Solved by the Invention

Ammonia adsorbed on unburnt carbon in the acidic deposit transferred to the cleaning fluid side by the cleaning, may be eluted, or at the time of cleaning during the operation of a rotary regenerator type heat exchanger, ammonia may be dissolved in the cleaning fluid due to leakage of ammonia injected for the purpose of flue gas denitration. In such a case, the pH value of the cleaning fluid may increase to a level which will not theoretically be reached by an aqueous sodium hydrogencarbonate solution. In such a case, it is difficult to judge the cleaning state from the behavior of the pH value of the cleaning fluid.

Further, the terminal point of cleaning can be most certainly judged by carrying out the cleaning while the cleaning state is directly visually observed. However, for this purpose, it is necessary to stop the operation of the boiler. In many cases, to stop the operation of the boiler means to stop the power generation, such being highly costly and undesirable.

In view of the above-described problems, it is an object of the present invention to provide a method for removing an acidic deposit containing a sulfur compound, whereby the terminal point of the cleaning state can simply be ascertained without necessity to visually directly observe the cleaning state or to observe the behavior of the pH value of the cleaning fluid.

Means to Solve the Problems

The present invention provide the following:

(1) A method for removing an acidic deposit containing a sulfur compound, which comprises contacting the acidic deposit with a prescribed amount of an aqueous cleaning fluid, characterized in that the concentration of sulfate ion ($SO_4^{2-}$) in the aqueous cleaning fluid is measured, and the contact with the aqueous cleaning fluid is terminated after the increase per hour of the measured value becomes not more than 10%.

(2) The method for removing an acidic deposit according to the above (1), wherein the sulfate ion concentration in the aqueous cleaning fluid is measured by adding barium chloride to the aqueous cleaning fluid to precipitate barium sulfate thereby to make the fluid turbid and measuring the absorbance of the turbid fluid.

(3) The method for removing an acidic deposit according to the above (2), wherein before precipitating barium sulfate thereby to make the fluid turbid, removal of an insoluble component in the aqueous cleaning fluid is carried out by filtration.

(4) The method for removing an acidic deposit according to any one of the above (1) to (3), wherein the acidic deposit is one deposited on an apparatus or piping disposed between a combustion furnace of a boiler and a chimney.

(5) The method for removing an acidic deposit according to the above (4), wherein the acidic deposit containing a sulfur compound is contacted with the aqueous cleaning fluid by immersing the acidic deposit in the aqueous cleaning fluid or spraying the aqueous cleaning fluid to the acidic deposit.

(6) The method for removing an acidic deposit according to any one of the above (1) to (5), wherein the aqueous cleaning fluid is an aqueous solution of an alkali metal carbonate or an alkali metal hydrogencarbonate.

(7) The method for removing an acidic deposit according to the above (6), wherein the concentration of the alkali metal carbonate or the alkali metal hydrogencarbonate in the aqueous cleaning fluid is from 3 to 50 mass %.

(8) The method for removing an acidic deposit according to any one of the above (1) to (7), wherein the aqueous cleaning fluid is an aqueous solution of sodium hydrogencarbonate.

Effects of the Invention

According to the present invention, judgment of the time point when the cleaning has been done can be clearly and simply carried out, whereby it is possible to shorten the cleaning time and to remove the acidic deposit efficiently.

MEANINGS OF SYMBOLS

Figure 1:
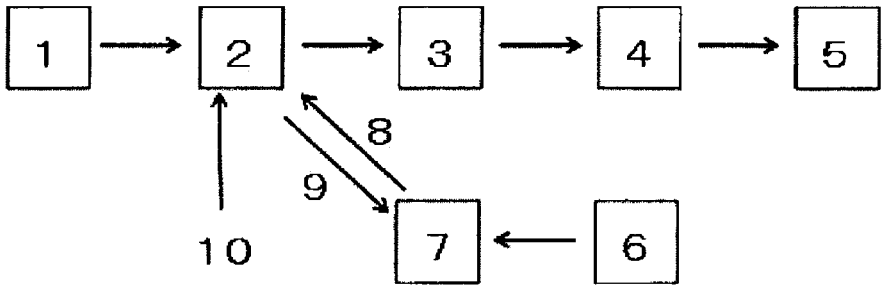
FIG. 1 is a view illustrating an embodiment for cleaning an apparatus for heat exchange between combustion air and exhaust gas generated by combustion of heavy oil.

1: Boiler
2: Gas air heater (GAH)
3: Dust collector
4: Desulfurization equipment
5: Chimney
6: Stirring vessel
7: Drainage pit
8: Piping for cleaning (going)
9: Piping for cleaning (returning)
10: Combustion air Best Mode for Carrying Out the Invention The present invention can be applied to removal of an acidic deposit deposited on an apparatus or its components, pipings, etc. disposed between a combustion furnace such as a boiler and a chimney. The apparatus disposed between the combustion furnace such as a boiler and the chimney may, for example, be an economizer, a gas air heater (GAH), a gas gas heater (GGH), an electric dust collector (EP), an exhaust gas heat recovery equipment (such as a $SO_3$ condenser) or a flue gas desulfurization equipment.

Removal of the acidic deposit is carried out by contacting it with a prescribed amount of an aqueous cleaning fluid. The means to contact the acidic deposit with a prescribed amount of an aqueous cleaning fluid is preferably a means to immerse the object to be removed in the aqueous cleaning fluid or a means to spray the aqueous cleaning fluid to the object to be removed. In a case where the aqueous cleaning fluid is contacted to the object to be removed, particularly in the spraying method, it is preferred to use the cleaning fluid by recycling.

The sulfur compound contained in the acidic deposit may be sulfuric acid or a sulfate. Namely, the acidic deposit contains, in addition to unburnt carbon, sulfuric acid ($H_2SO_4$), ammonium hydrogensulfate (another name: acidic ammonium sulfate, $(NH_4)HSO_4$), etc. derived from sulfur contained in the fuel and shows strong acidity when dissolved in water. Accordingly, as the aqueous cleaning fluid, it is preferred to employ an aqueous solution of an alkali metal carbonate or an alkali metal hydrogencarbonate. The concentration of the alkali metal carbonate or the alkali metal hydrogencarbonate in the aqueous cleaning fluid is preferably from 3 to 50 mass %, particularly preferably from 5 to 20 mass %. More specifically, in the case of an alkali metal carbonate, the concentration is preferably from 3 to 50 mass %, particularly preferably from 5 to 20 mass %. Whereas, in the case of an alkali metal hydrogencarbonate, the concentration is preferably from 3 to 16 mass %, particularly preferably from 5 to 10 mass %.

In the present invention, the prescribed amount of the aqueous cleaning fluid means that relative to the amount of the sulfur component contained in the acidic deposit to be removed, preferably from 1 to 2 times by mol, particularly preferably from 1 to 1.5 times by mol, of an alkali metal carbonate, or preferably from 2 to 4 times by mol, particularly preferably from 2 to 3 times by mol, of an alkali metal hydrogencarbonate, is contained in the aqueous cleaning fluid. If the amount of the aqueous cleaning fluid is insufficient, the cleaning tends to be poor, and on the other hand, if it is excessive, the cleaning cost tends to be large, such being also undesirable.

In the present invention, as the alkali metal carbonate or the alkali metal hydrogencarbonate, sodium carbonate, potassium carbonate, sodium hydrogencarbonate or potassium hydrogencarbonate may, for example, be mentioned. Among them, sodium hydrogencarbonate is particularly preferred, since it is weakly alkaline with a low pH value when dissolved in water, whereby the hydrogen ion concentration will not exceed the value regulated in Water Pollution Control Law, and it can be safely handled by a worker. In a case where inclusion of sodium is to be avoided, or in a case where the concentration of the aqueous solution is to be increased, it is preferred to use potassium hydrogencarbonate.

The alkali metal carbonate or the alkali metal hydrogencarbonate will react with the acidic deposit to generate carbon dioxide gas which accompanies with bubbling, whereby the acidic deposit will be dissolved while being exfoliated by the mechanical function of bubbling. At the same time, iron rust, dust, soot, etc. in the acidic deposit will also be exfoliated and removed. By such bubbling of carbon dioxide, the cleaning effect will be improved, and the cleaning time can be shortened. Even when the object to be cleaned has a complex shape which makes cleaning usually difficult, it can be cleaned in a short time.

It is preferred to employ an alkali metal hydrogencarbonate for cleaning utilizing the bubbling, since as compared with an alkali metal carbonate, the alkali metal hydrogencarbonate has a large content of a carbonate group per unit mass of the substance. Among alkali metal hydrogencarbonates, it is particularly preferred to use sodium hydrogencarbonate, since it contains the largest amount of a carbonate group per unit mass of the substance. However, in a case where the pH value during the cleaning is to be adjusted to a level of at least 9, it is preferred to use an alkali metal carbonate or an alkali metal hydrogencarbonate other than sodium hydrogencarbonate.

In the present invention, the concentration of sulfate ion ($SO_4^{2-}$) in the cleaning fluid is measured, and the cleaning is terminated after the increase per hour of the measured value becomes not more than 10%. Here, the smaller the increase of the measured value is, the higher the accuracy for the termination of cleaning becomes. Accordingly, the increase per hour of the measured value to be the basis for termination of the cleaning is preferably at most 7%, more preferably at most 5%. The time between measurements is preferably at least 20 minutes taking the operation efficiency into consideration, and it is specifically preferably every 30 minutes or every 60 minutes. Further, when the object to be cleaned is, for example, a rotary gas air heater, the time between measurements is preferably set to be a multiple of the time of one rotation of the rotor, whereby a bias in the cleaning degree can be eliminated.

The concentration of sulfate ion can be measured by the following methods. (1) The ion chromatography prescribed in JIS K0102-41.3, (2) the gravimetric method prescribed in JIS K0102, (3) the turbidimetric method prescribed in JIS K8001, and (4) a method for measuring the absorbance of visible light having a prescribed wavelength by a cleaning fluid made turbid by precipitation of barium sulfate by means of barium chloride. In the measurement, if it takes time for treatment of the sample, it becomes difficult to determine the sulfate ion concentration and judge the cleaning state quickly during the cleaning, whereby it may take a long time for waiting for the judgment. In such a case, in the case of e.g. a boiler, it will take a long time until a gas air heater or the like can be used, thus leading to an increase of the operation cost. The method of the above (4) can be used most suitably, since the result can be obtained quickly as compared with the methods of the above (1) to (3).

With respect to the device for measuring the transmittance of the cleaning fluid, various types are commercially available. However, it is preferred that the device is portable, its operation is easy, and the method for treating the sample for measurement is easy, so that the measurement can be made at the site where the cleaning of an apparatus, piping or the like is carried out. Among the analytical methods for a sulfur oxide prescribed in JIS K0103, there is a method wherein turbidity is formed by reacting sulfate ion with a reagent and analyzed. In this method, a glycerol/sodium chloride aqueous solution as a suspension stabilizer and an aqueous barium chloride solution as a suspension-forming agent are sequentially added, and the measurement is carried out with a visual light of 420 nm. However, by such an analytical method, it takes time for the pretreatment of the sample. Therefore, it is preferred to employ a suspension-forming agent AC2082 manufactured by Thermo Orion and to use a chromometer Model AQ 2005 manufactured also by Thermo Orion, whereby the measurement is carried out by means by a visible light of 528 nm.

In the cleaning fluid for the acidic deposit, a water-insoluble component such as fine particles of unburnt carbon or rust, which is insoluble in water, is contained in an amount of from 0.1 to a few tens mass %, in addition to sulfuric acid, ammonium hydrogensulfate, etc. Therefore, it is necessary to remove such a water-insoluble component before the measurement. For the removal of the water-insoluble component, a membrane filter is preferably employed. As an example of such a filter, DISMIC-13HP PTFE 0.45 μm (HYDROPHILIC) manufactured by ADVANTEC may be mentioned, but it is not limited to such a filter so long as the water-insoluble component in the cleaning fluid can thereby be removed.

The sulfate ion concentration in the cleaning fluid sample is high at a level of from 0.1 to 20 mass %. On the other hand, the measurable range by the above-mentioned measuring device is as low as from 5 to 200 mg/L. Accordingly, it is preferred that the filtrate obtained through the filter is diluted to a proper level by addition of water to bring the sulfate ion concentration of the sample to be within the measurable range by the measuring device, and then measuring is carried out. The water-insoluble component is likely to scatter the incident light for the measurement at the time of measurement by the above-mentioned measuring device, and accordingly, the water to be used for the purpose of dilution preferably contains no water-insoluble component. It is possible to employ industrial water, tap water or purified water containing no water-insoluble component may be employed, but it is necessary to pay attention to the concentration of the dissolved sulfate ion. It is said that usually, tap water contains sulfate ion at a concentration of from about 5 to 20 mg/L, and it is preferred to preliminarily measure the sulfate ion concentration in water to take a blank.

After washing with an aqueous solution of an alkali metal carbonate or an alkali metal hydrogencarbonate, rinsing is carried out by using industrial water. Also for determining the terminal point of such rinsing, the method of the present invention may be applied. In such a case, it is preferred to preliminarily measure the sulfate ion concentration of the industrial water to be used.

In the present invention, attention is drawn to the sulfate ion considered to be derived from the acidic deposit. However, if attention is drawn to a chemical species derived from the acidic deposit, which can be detected in the cleaning fluid, cleaning management is possible in principle. For example, ammonium ion ($NH_4^+$), magnesium ion ($Mg^{2+}$), iron ion ($Fe^{3+}$), vanadium ion ($V^{5+}$), potassium ion ($K^+$) or fluorine ion ($F^-$) may be mentioned as a chemical species useful for such cleaning management. As compared with such chemical species, sulfate ion is scarcely susceptible to influences of external turbulence such as the type of the fuel, leakage of an exhaust gas from other systems during the operation or a component contained in e.g. water to be used for cleaning. Accordingly, it is preferred to select sulfate ion as an index for cleaning management.

EXAMPLES

Now, an embodiment of the present invention will be described in detail with reference to FIG. 1.

FIG. 1 is a view illustrating an embodiment for cleaning a gas air heater 2 which is an apparatus for heat exchange between combustion air 10 and an exhaust gas generated when heavy oil is burned by a boiler 1. The exhaust gas is heat-exchanged with combustion gas 10 in a gas air heater 2 and cooled, and then it passes through a dust collector 3 and a sulfurization equipment 4 and is discharged from a chimney 5.

The boiler 1 is a private power generator boiler with an evaporation amount of 380 t/hr, using Bunker C having a sulfur content of 3.0 mass %, as a fuel, and a gas air heater 2 (construction: 1B2GAH, type: vertical (V-type) rotary regeneration heat exchanger) is provided. A 5 mass % sodium hydrogencarbonate aqueous solution prepared in a stirring vessel 6 was used as a cleaning fluid, and it was recycled between a drainage pit 7 and the gas heater 2 via a piping for cleaning (going) 8 and a piping for cleaning (returning) 9, whereby it is sprayed from a nozzle for cleaning installed at the gas air heater 2 to clean the gas air heater 2. At that time, the terminal point of cleaning was ascertained.

The above installation is operated usually by introducing an exhaust gas from one boiler to two gas air heaters, whereby each gas air heater can be cleaned separately from another gas air heater without stopping the operation of the boiler. This method was employed.

Example 1 (Example of the Invention)

Figure 2:
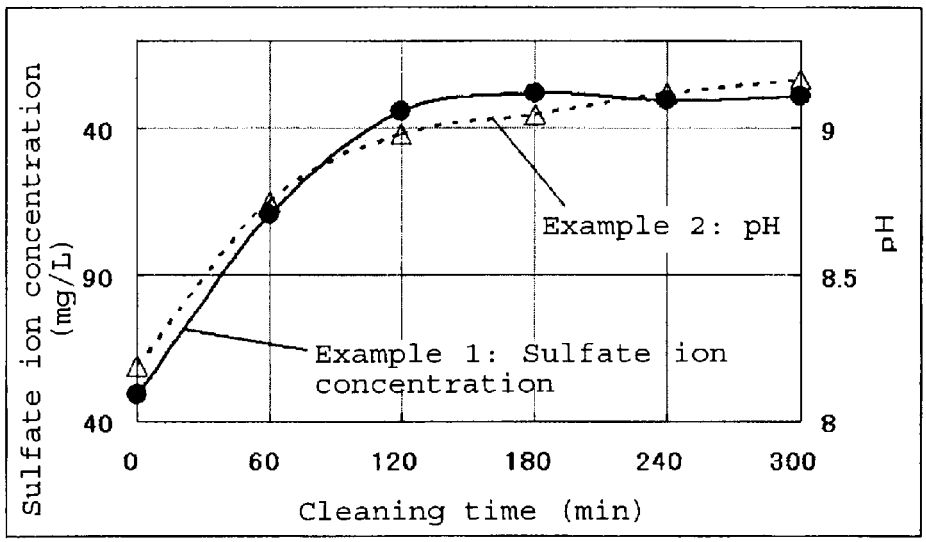
FIG. 2 is a graph showing the change in the sulfate ion concentration in Example 1 and the change in the pH value in Example 2, as the cleaning time passes.

From the piping for cleaning (returning) (9 of FIG. 1) during the cleaning of the gas air heater, the cleaning fluid was sampled, filtered through a membrane filter and diluted 100 times with tap water. A suspension-forming agent AC2082 (manufactured by Thermo Orion) was added thereto to prepare a sample, and the concentration of sulfate ion in the cleaning fluid was measured every time upon expiration of a predetermined cleaning time by means of a chromometer Model AQ 2005 (manufactured by Thermo Orion). The results are shown in Table 1 and FIG. 2. In Table 1, 0 (min) means immediately after the initiation of cleaning.

Example 2 (Comparative Example)

From the piping for cleaning (returning) (9 of FIG. 1) during the cleaning of the gas air heater, the cleaning fluid was sampled, and the pH value was measured. The results are shown in Table 1 and FIG. 2.

Example 3 (Comparative Example)

From the piping for cleaning (returning) (9 in FIG. 1) during the cleaning of the gas air heater, the cleaning fluid was sampled, and the bubbling state was visually evaluated. The results are shown in Table 1. In Table 1, the symbols have the following meanings.

◎: It is possible to clearly distinguish the bubbling state due to the neutralization reaction.

Δ: It is difficult to clearly distinguish the bubbling due to the stirring effect from the bubbling due to the neutralization reaction.

TABLE 1

| | | | | | | | |
|---|---|---|---|---|---|---|---|
| Cleaning time | (min) | 0 | 60 | 120 | 180 | 240 | 300 |
| Sulfate ion | (mg/L) | 49 | 111 | 146 | 152 | 150 | 151 |
| PH | (-) | 8.19 | 8.87 | 8.98 | 9.05 | 9.12 | 9.17 |
| Bubbling state | (-) | ◎ | Δ | Δ | Δ | Δ | Δ |

In Example 2, the pH value of the cleaning fluid increased as the cleaning time passed, and the aqueous sodium hydrogencarbonate solution showed a behavior such that the pH value exceeded a usual level (from 8.3 to 8.6). One of the reasons may be such that slightly excess ammonia initially injected for the purpose of flue gas desulfurization was adsorbed in the acidic deposit, and this ammonia was dissolved in the cleaning fluid during the cleaning. Further, it is also conceivable that at the time of separating the gas air heater for cleaning, an operation to close the shielding system is carried out, but if the shielding system is not completely closed due to e.g. deposition of ash on the shielding plate, the exhaust combustion gas may leak into the gas air heater side during the cleaning, and consequently, ammonia in the exhaust gas may be dissolved in the cleaning fluid. Since the pH value substantially exceeded the value which the aqueous sodium hydrogencarbonate solution should normally have, and showed a behavior of gradual increase, it was difficult to judge the terminal point of the cleaning by observing the change in the pH value even in combination with observation of the bubbling state.

Whereas, in Example 1, a phenomenon was observed such that as the cleaning time passed, the increase in the concentration of sulfate ion in the cleaning fluid tends to stop. The sulfate ion is derived from the acidic deposit. At the time point of 180 minutes, the increase per hour of sulfate ion was (152−146)/146×100=4.1%, whereby it was possible to judge that the cleaning of the device was substantially completed.

Industrial Applicability

According to the present invention, at the time of washing off an acidic deposit containing, as an object to be washed off, an acidic component derived from a sulfur oxide, it is possible to simply ascertain the terminal point of the cleaning without necessity to visually directly observe the cleaning state or to observe the behavior of the pH value of the cleaning fluid. Namely, it is suitable for use to ascertain the cleaning state in cleaning during an operation where a visual inspection for ascertaining the cleaning state is impossible or in cleaning where due to leakage of an alkaline substance, the pH value of the cleaning fluid tends to be alkaline.

The entire disclosure of Japanese Patent Application No. 2005-230827 filed on Aug. 9, 2005 including specification, claims, drawings and summary is incorporated herein by reference in its entirety.

What is claimed is:

1. A method for removing an acidic deposit containing a sulfur compound, which comprises:

preparing an aqueous cleaning fluid comprising a prescribed molar amount of an alkali metal carbonate or alkali metal hydrogen carbonate;

contacting the acidic deposit with a prepared aqueous cleaning fluid by spraying;

collecting the contacted cleaning fluid; and recycling the collected cleaning fluid;

measuring a rate of concentration increase of sulfate ion ($SO_4^{-2}$) in the aqueous cleaning fluid by repeated measuring at time intervals ranging from 20 to 60 minutes;

determining a percent increase of the sulfate ion concentration per hour; and terminating the contact with the aqueous cleaning fluid after the increase per hour of the measured per cent increase becomes not more than 10%, wherein the prescribed molar amount of alkali mental carbonate is in the range of 1 to 2 moles per mole of the sulfur component and the prescribed molar amount of the alkali metal hydrogen carbonate is 2 to 4 moles per mole of the sulfur component.

2. The method for removing an acidic deposit according to claim 1, wherein the measuring a sulfate ion concentration in the aqueous cleaning fluid comprises:

adding barium chloride to the aqueous cleaning fluid;

precipitating barium sulfate which makes the fluid turbid; and measuring the absorbance of the turbid fluid.

3. The method for removing an acidic deposit according to claim 2, further comprising before precipitating barium sulfate and making the fluid turbid, filtering the aqueous cleaning fluid to remove an insoluble component.

4. The method according to claim 3, wherein a membrane filter is employed for the filtering.

5. The method according to claim 2, wherein the measuring an absorbance comprises measuring a light of 528 nm.

6. The method for removing an acidic deposit according to claim 1, wherein the acidic deposit is one deposited on an apparatus or piping disposed between a combustion furnace of a boiler and a chimney.

7. The method for removing an acidic deposit according to claim 6, wherein the acidic deposit containing a sulfur compound is contacted with the aqueous cleaning fluid by spraying the aqueous cleaning fluid to the acidic deposit.

8. The method for removing an acidic deposit according to claim 7, wherein the aqueous cleaning fluid is an aqueous solution of sodium hydrogencarbonate.

9. The method according to claim 8, wherein a concentration of sodium hydrogen carbonate is from 3 to 16 mass %.

10. The method for removing an acidic deposit according to claim 7, wherein the contacting the acidic deposit with a prescribed amount of an aqueous cleaning fluid is by spraying the acidic deposit with a prescribed amount of an aqueous cleaning fluid.

11. The method for removing an acidic deposit according to claim 1, wherein a concentration of the alkali metal carbonate or the alkali metal hydrogencarbonate in the aqueous cleaning fluid is from 3 to 50 mass %.

12. The method for removing an acidic deposit according to claim 11, wherein a concentration of the alkali metal carbonate or alkali metal hydrogen-carbonate in the aqueous cleaning fluid is from 5 to 20 mass %.

13. The method according to claim 11, wherein the prescribed amount is a mole ratio of the alkali metal carbonate to the amount of sulfur component contained in the acidic deposit to be removed of 1/1 to 2/1, or a mole ratio of the alkali metal hydrogen carbonate of from 2/1 to 4/1.

14. The method according to claim 1, wherein the alkali metal carbonate or the alkali metal hydrogen carbonate is at least one selected from the group consisting of sodium carbonate, potassium carbonate, sodium hydrogen carbonate and potassium hydrogen carbonate.

15. The method according to claim 1, wherein the measuring a concentration of sulfate ion comprises diluting a sample with water to bring the concentration of sulfate ion to be within a measurable range.

16. A method for removing an acidic deposit containing a sulfur compound, which comprises:

preparing an aqueous cleaning fluid comprising a prescribed molar amount of an alkali metal carbonate or alkali metal hydrogen carbonate;

continuously contacting the acidic deposit with a prepared aqueous cleaning fluid;

measuring a rate of concentration increase in the aqueous cleaning fluid of a species derived from the acidic deposit by repeated measuring at time intervals ranging from 20 to 60 minutes;

determining a percent increase of the species derived from the acidic deposit concentration per hour; and terminating the contact with the aqueous cleaning fluid after the increase per hour of the measured per cent increase becomes not more than 10%;

wherein the species derived from the acidic deposit is one specie selected from the group consisting of ammonium ion, magnesium ion, iron ion, vanadium ion, potassium ion and fluoride ion.

* * * * *